US007676856B1

(12) United States Patent
Graham, II

(10) Patent No.: US 7,676,856 B1
(45) Date of Patent: Mar. 16, 2010

(54) DEODORIZING DEVICE FOR TOILET BOWLS

(76) Inventor: Richard D. Graham, II, 24516 Breckenbridge Pl., Newhall, CA (US) 91321

( * ) Notice: Subject to any disclaimer, the term of this patent is extended or adjusted under 35 U.S.C. 154(b) by 98 days.

(21) Appl. No.: 11/767,367

(22) Filed: Jun. 22, 2007

Related U.S. Application Data

(63) Continuation-in-part of application No. 11/233,758, filed on Sep. 23, 2005, now abandoned.

(51) Int. Cl.
*E03D 9/00* (2006.01)

(52) U.S. Cl. ..... 4/228.1

(58) Field of Classification Search ..... 4/222, 4/223, 228.1, 231; 222/255, 402.15; 239/274, 239/579

See application file for complete search history.

(56) References Cited

U.S. PATENT DOCUMENTS

| | | | | |
|---|---|---|---|---|
| 3,178,070 | A * | 4/1965 | Leland | 4/223 |
| 4,670,916 | A * | 6/1987 | Bloom | 4/231 |
| 5,031,259 | A | 7/1991 | Baiera et al. | |
| 5,307,525 | A | 5/1994 | O'Brien | |
| 5,383,237 | A | 1/1995 | Baker | |
| 5,862,532 | A | 1/1999 | Cain | |
| 6,029,286 | A | 2/2000 | Funk | |
| 6,054,423 | A | 4/2000 | McGill | |
| 6,178,563 | B1 | 1/2001 | Helfet | |
| 6,387,321 | B1 | 5/2002 | McGill | |
| 6,654,971 | B1 | 12/2003 | Middleton | |
| 6,785,911 | B1 | 9/2004 | Percher | |
| 6,785,912 | B1 | 9/2004 | Julio | |
| 2003/0145369 | A1 | 8/2003 | Hunnicutt, Jr. | |
| 2003/0229938 | A1 | 12/2003 | Hayashi | |

(Continued)

OTHER PUBLICATIONS

Oust® Mini Air Santizer; MINIMUS.biz; 1 page; printed on Jun. 12, 2007.

*Primary Examiner*—Tuan N Nguyen
(74) *Attorney, Agent, or Firm*—Law Offices of David L. Hoffman

(57) ABSTRACT

A device for controlling odor from a toilet bowl has a housing primarily formed by a top member, a bottom member and a canister holding section for attaching to the bottom member. The canister holding section holds a canister having a nozzle for providing an odor treating spray from the canister. The housing also has two plates depending downwardly from the bottom member and which form an inverted U-shape for mounting the device on a rim of the toilet bowl. Between the top member and bottom member is a biasing device such as springs for biasing a seat of the toilet bowl in an upward direction when the seat is empty, and for allowing the seat to move in a downward direction in response to someone sitting on the seat. The downward motion of the seat moves the top member down, thereby actuating a nozzle on the canister, spraying a metered amount a substantially fixed predetermined amount, of spray into the toilet bowl. A method of deodorizing the bowl in response to sitting includes mounting a device on the rim, biasing the seat into a first position which is not fully down, responding to someone sitting on the seat by moving a top member down in response to the seat moving down, and causing a metered amount of spray from the nozzle of the canister to be sprayed into the bowl.

19 Claims, 4 Drawing Sheets

U.S. PATENT DOCUMENTS

2004/0064884 A1 4/2004 Egeresi
2004/0128751 A1 7/2004 Haq
2004/0266638 A1 12/2004 Requejo

* cited by examiner

DEODORIZING DEVICE FOR TOILET BOWLS

CROSS REFERENCE TO RELATED APPLICATION(S)

This continuation in part application is a continuing application of U.S. patent application Ser. No. 11/233,758 filed Sep. 23, 2005, now abandoned and incorporated by reference herein and from which priority is claimed.

BACKGROUND OF THE INVENTION

1. Field of the Invention

The present invention relates to a deodorizing device for toilet bowls, and more specifically to a deodorizing device that is automatically triggered.

2. Description of the Related Art

The problem of deodorizing bathrooms and toilet bowls due to odors from a bowel movement has long existed. One solution is simply to manually spray deodorizer in the bathroom. Another solution is to keep deodorizing that works all the time in the bathroom.

Other solutions have been created that are intended to automatically deodorize in response to some event connected to going to the bathroom. For example, U.S. Patent Publication. No. 2004/0064884 to Egeresi teaches a toilet odor blocking system which applies soapy water and foam or chemical spray into the bowl upon the user's sitting on the toilet seat to block any odors from emanating from any waste. The bubbles for covering the human waste are guided through an embedded hose in the toilet seat.

U.S. Pat. No. 6,029,286 to Funk discloses an apparatus for manually delivering an odor reducing chemical to a toilet bowl comprising a remotely located pressurized source of odor reducing chemical, a valve communicatively connected to the pressurized source of odor reducing chemicals for selectively releasing odor reducing chemical from the pressurized source, a button located at a location remote from said pressurized source of odor reducing chemical for opening said valve when activated by a user, where the activating mechanism may be selectively activated one or more times by the user either before, after or while the user is seated. The device has a bracket for mounting on a toilet, and a spray nozzle.

U.S. Pat. No. 6,387,321 to McGill discloses a process for controlling toilet odors by use of compositions comprising a hypochlorite compound and a hydrogen peroxide compound. The compositions are useful for preventing, reducing and/or eliminating the odor emitting capacity of human or animal excrement in an aqueous solution. A conventional liquid-dispensing mechanism may be configured to automatically dispense an odor-reducing, -preventing or -eliminating amount of the active ingredients when a user sits on the seat of the toilet.

U.S. Pat. No. 5,862,532 to Cain discloses a dispenser which fails to automatically dispense the deodorant, and instead requires the user to press a knob to spray the freshener into the toilet bowl. This invention is not practical for the fact that user can instead press the knob of the spray can and spray the deodorant into the bowl. Furthermore, Cain's invention has a very unhygienic way of delivering the spray mist into the bowl through a head placed on the bowl where it will accumulate with liquid and solid waste.

U.S. Patent Application 20040266638 to Requejo et al. discloses compositions and methods designed to manage toilet odor which comprise a fragrance and other compounds for reacting with substances that cause toilet malodor. Compositions are in a package and may be dispensed into conventional toilets, either before, during or after use U.S. Pat. No. 5,383,237 to Baker discloses a new and improved toilet seat deodorizer apparatus which includes a flexible, resilient air pump assembly shaped substantially in the form of a toilet seat, a connector assembly for connecting the air pump assembly to a toilet bowl, and an odor dispenser assembly connected to the air pump assembly. The odor dispenser assembly includes a first screened end in direct communication with air contained within the flexible, resilient air pump assembly and includes a second screened end in direct communication with air which is outside the air pump assembly and the odor dispenser assembly. When a person sits upon the flexible, resilient air pump assembly, a quantity of air is pumped from inside the air pump assembly, through the odor dispenser assembly, to outside the odor dispenser assembly to room air in the room in which the toilet is located.

U.S. Pat. No. 5,307,525 to O'Brien teaches adding a few drops of an appropriate fluid mixture, such as a chlorinated hydrocarbon containing a small amount of a volatile fragrant fluid, to water in a toilet bowl prior to the use of the toilet. A unique property of the first fluid causes the resultant mixture to spread quickly over the entire surface of the water, forming a nonpermeable film across which the odor emanating from unflushed feces cannot pass. The second fluid quickly vaporizes from this film allowing the resulting concentrated fragrance to neutralize within the toilet bowl the flatulence odor produced during a bowel movement. A person sitting upon the toilet seat actuates a semiautomatic fluid dispenser.

U.S. Pat. No. 6,785,912 to Julio discloses a toilet seat with a mechanism to send ions into the bowl.

U.S. Pat. No. 6,178,563 to Helfet discloses a toilet deodorizer having a pump housing in the form of a cylinder and a piston. The cylinder is mounted on a toilet seat of a conventional toilet. When sitting on the toilet seat, the toilet seat moves downward which causes the piston to move within the cylinder which then causes dispersion of liquid from a pump chamber of the cylinder to a wide area of the toilet bowl. When the user gets up from the toilet seat, the toilets seat is lifted which causes retraction movement between the piston and the cylinder which causes a new quantity of liquid to be pulled through an inlet valve into the pump chamber, from a storage tank mounted on the side of the toilet's tank, while maintaining the outlet valve closed. This piston and cylinder structure is very complex, and requires a separate storage tank mounted to the toilet's tank.

What is needed is a spray that is automatic, compact, does not involve blowing air or power sources, does not offend the user, and acts at the source of the problem. Such a device should also be easy to mount, nonobtrusive, and spray only a desired amount.

SUMMARY OF THE INVENTION

In one embodiment, there is a deodorizing and/or disinfecting spray device actuated by sitting on a toilet seat, which sprays deodorizing chemicals into the bowl. A mounting structure with a resilient actuator arm activates the spray when the user sits.

In a preferred embodiment, the device has a housing with a lower portion having an inverted U-shape to fit over a standard rim of a toilet bowl, a compact spray container mounted on the housing, an upper actuating lever biased upward against the underside of the bowl's seat, and a mechanism for movably connecting the lever to the housing, a delivery nozzle for delivering a spray from the spray container generally downward into the bowl.

In a method of delivering the spray to the bowl, a user sits on the bowl's seat and this moves the lever downward pushing down the spray nozzle of the spray container until the nozzle is at maximum deflection delivering a single metered spray to the bowl, i.e., a substantially fixed predetermined amount. Only one spray is delivered even though the user still sits on the seat and the nozzle is fully depressed. Further spray will not occur until the user gets up off of the seat allowing the biasing mechanism to push up on the seat until the spray nozzle is back at its original position, and thereafter the same or a different user sits back down on the seat.

DESCRIPTION OF THE PREFERRED EMBODIMENT(S)

Figure 1:
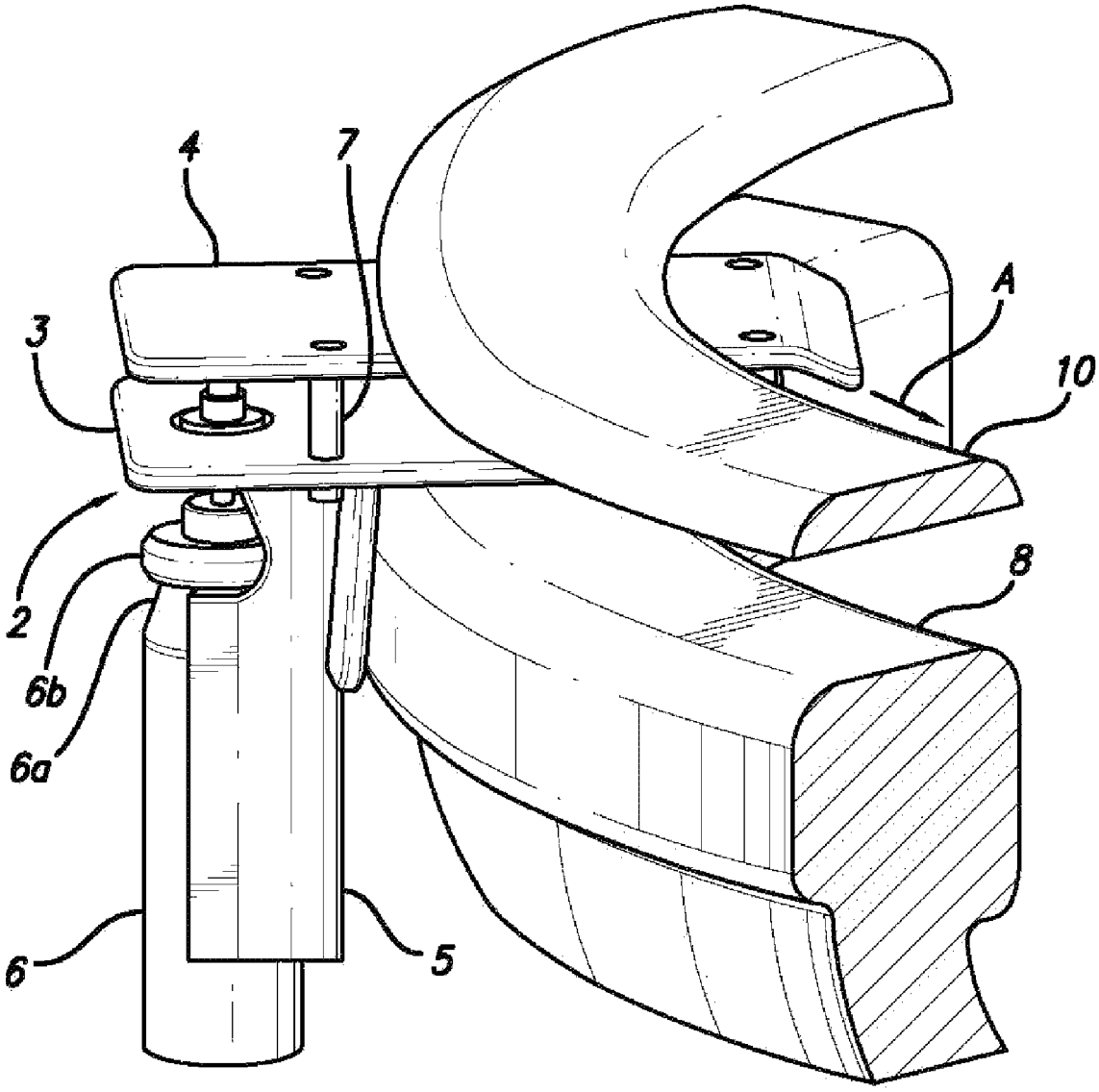
FIG. 1 is a partial perspective view of a device in accordance with a first embodiment of the invention mounted on a toilet bowl and having a seat portion of the bowl sitting on top of the device.
Figure 2:
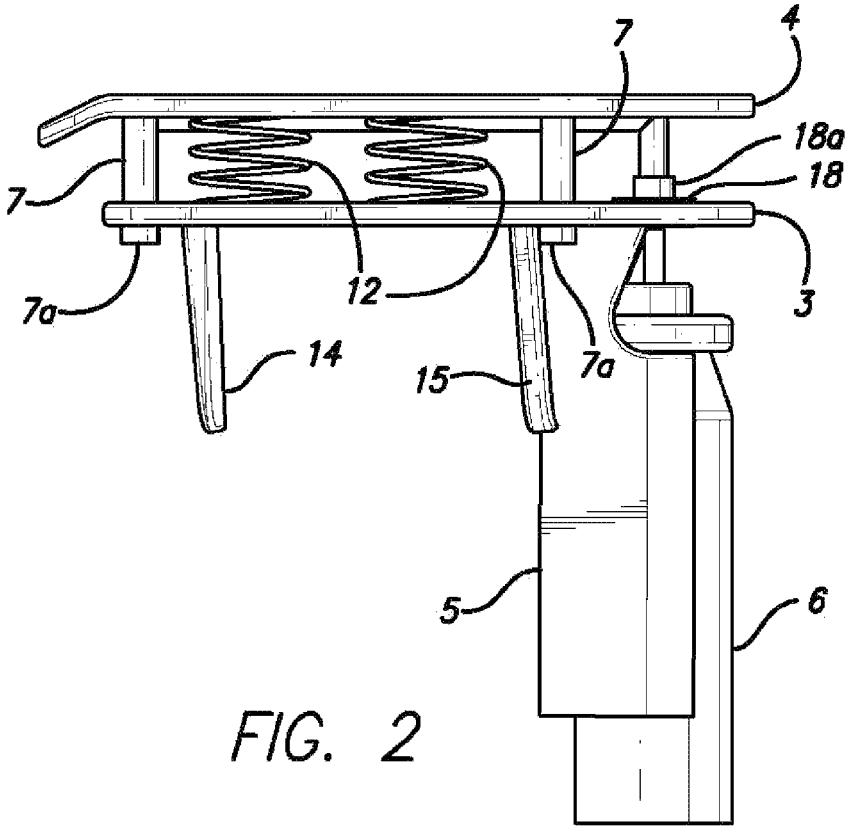
FIG. 2 is an elevational view of the device of FIG. 1.
Figure 3:
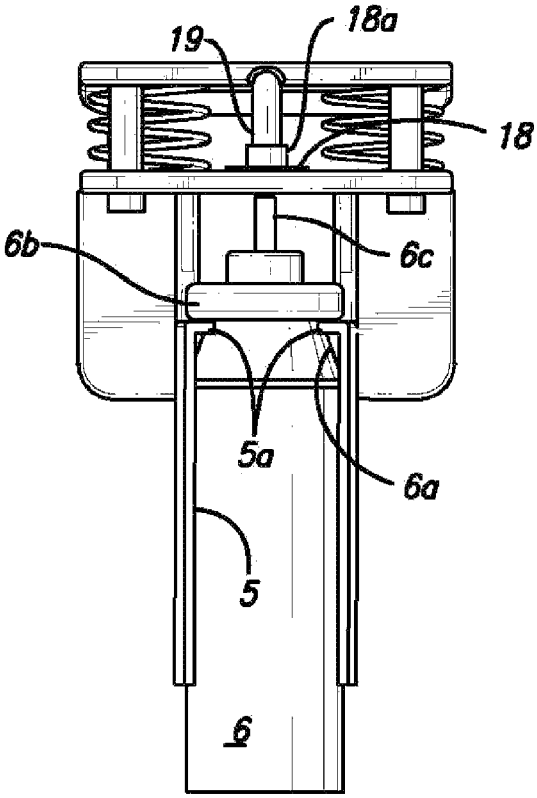
FIG. 3 is a side elevational view of the device of FIG. 1.
Figure 4:
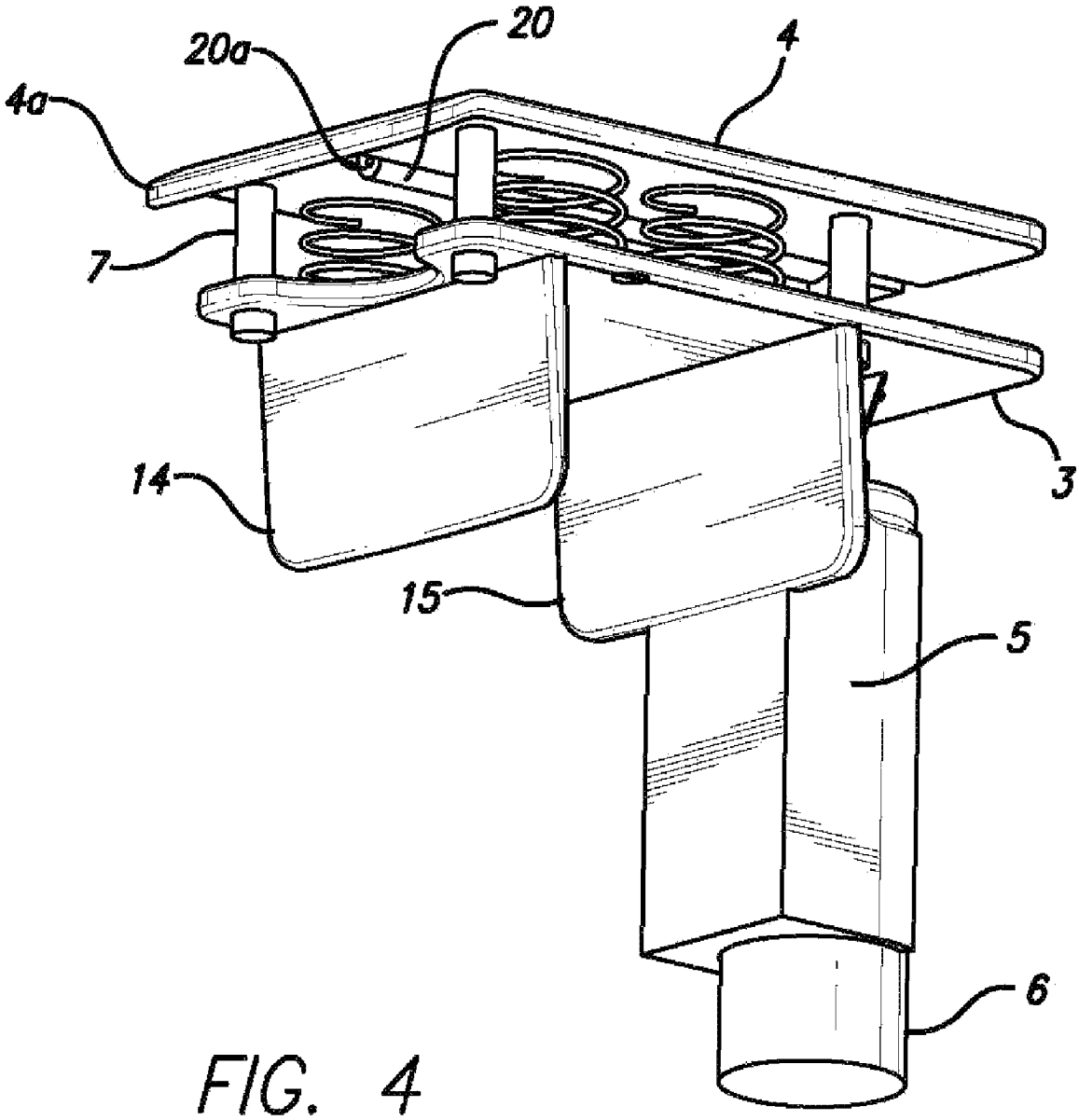
FIG. 4 is a perspective view from an angle below the device of FIG. 1.
Figure 5:
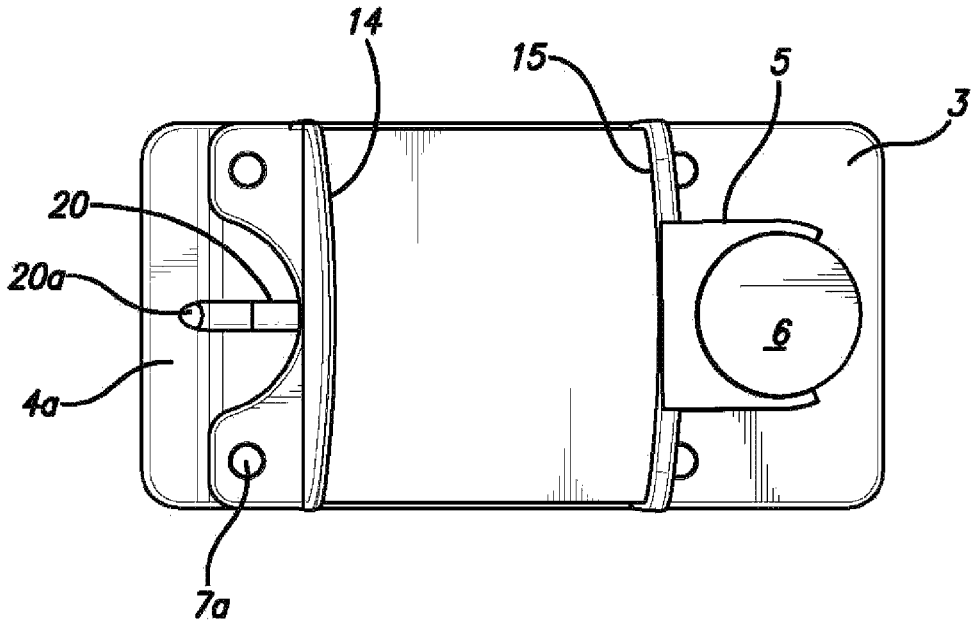
FIG. 5 is a bottom view of the device of FIG. 1.

In one embodiment, there is a deodorizing and/or disinfecting spray device actuated by sitting on a toilet seat, which sprays deodorizing chemicals into the bowl.

As shown in FIGS. 1-5, device 2 has a housing which may include a base member 3, a top member 4, and a canister holding section 5 which holds a deodorizing spray canister 6. In addition, device 2 has posts 7 fixed to, or unitary or integral with, an underside of top member 4. Preferably there are four posts. Posts 7 pass through holes in base member 3 and have a widened lower end 7*a* which is larger than the hole. In addition, there is a biasing mechanism to bias the top member 4 upward and away from the base member 3. The biasing mechanism is preferably a spring, or as shown, multiple springs 12, preferably fixed to the top surface of base member 3 and underside of top member 4. Other biasing mechanisms may be used, such as a resilient or rubber member.

The device also has two panels 14, 15 extending downward from the underside of base member 3. The panels 14, 15 form a U-shape together with the base member 3 that is sized to fit over a rim 8 of a standard toilet bowl. If desired, one or both panels 14, 15 may be adjustable to vary the distance between them to provide a close fit on a variety of sizes of rim 8. An example of such an adjustable system is provided on many toilet bowl safety locks to protect against babies and toddlers getting access to the bowl.

One or both panels are integrally attached or unitary with the base member.

The canister holding section 5 is preferably a simple C-shaped clamp which friction fits (including, e.g., snap fitting) canister 6. Canister 6 has a neck 6*a* near the top and a ring 6*b* above the neck which ring may be used to also hold canister 6. In other words, the C-shaped holding section 5 may have an inward projection 5*a* forming a flange that fits below ring 6*b* and in neck 6*a*. The canister holding section 5 may be integral and/or unitary with panel 14 (front panel). The device may also have reinforcing webs or triangles (not shown) to support the panels 14, 15, respectively, at their connections to the underside of bottom member 3.

The top of the canister 6 has a nozzle 6*c* with a ring 18 preferably slidably fitted around the nozzle 6*c*. Ring 18 has an upward collar 18*a* that receives and is preferably fixed to or unitary with an elbow 19. Elbow 19 in turn receives a long tube 20.

Figure 6:
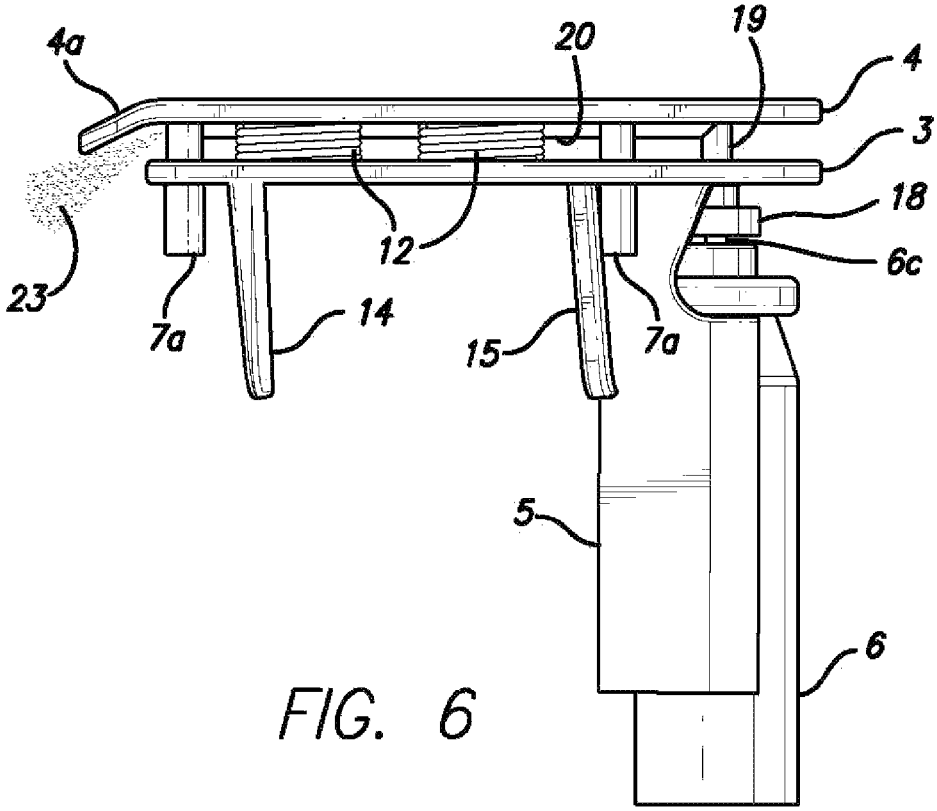
FIG. 6 is a view similar to FIG. 2 with the device being actuated.

In operation, when a person sits on seat 10, top member 4 is pushed down toward and relative to bottom member 3. As shown in FIG. 6, to allow for downward relative motion, posts 7 move downward through holes in bottom member 3. Elbow 19 moves downward and collar 18*a* and ring 18 downward. When elbow 19 moves downward, its lower end is sized to meet the top end of nozzle 6*c* and force the nozzle downward to actuate odor treating spray 23 such as deodorizing fluid and/or disinfecting fluid. Preferably, the canister is small, so as to be nonobtrusive, e.g., a canister of about two inches (2") long and about one half inch (½") in diameter may be used. Together, top member 4 and elbow 19 form a link member to transfer downward motion to the nozzle. The canister preferably holds the fluid therein under pressure.

The deodorizing fluid passes up from the body of the canister 6, through the nozzle 6*c* (with ring and collar around it) and into the elbow 19 and then tube 20.

The exit end 20*a* of tube 20 is sized to atomize the deodorizing fluid. Preferably front end 4*a* of top member 4 is bent downward, acting as a deflector for the spray, which helps direct the spray into the bowl (in direction A of FIG. 1) and also helps keep a direct spray from hitting the user in the bottom.

The spray canister 6 is preferably a metered spray canister, such as marketed under the name OUST®, a trademark of S.C. Johnson & Son, Inc. of Racine, Wis. The metered spray, i.e., a substantially fixed predetermined amount, enables the canister to be actuated just once when the user sits on the seat, rather than continuously spraying while the user is sitting on the seat. Continuously spraying is not preferred, but if the spray is sufficiently slow, it might be acceptable, i.e., slower than typical spray cans. The fluid spray may be deodorizing and/or disinfecting and/or air freshening.

When the user gets up, the springs or biasing member return the top member 4 to its initial position against the weight of the toilet seat. The spring force must be sufficient to hold the seat up beyond the point of actuation of the spray nozzle.

It is noted that the spray nozzle can be set to spray before full compression of the springs and/or before the top member 4 would reach the bottom member 3. In any event, the distance that the top is separated from the bottom has to be at least about the minimum compression of the springs plus the minimum distance to actuate the nozzle.

In a method in accordance with another embodiment of the invention, the spray into the bowl occurs at least as soon as the user sits on the seat, and this spray acts within the limited space defend by the bowl and the user's bottom, which acts to provide a substantially enclosed space. Therefore, when the user defecates, there is spray mist in the enclosed space that acts on any emanating odors right at the bowl. The result is a remarkably effective deodorizing device and method.

Preferably the spray in the method is metered or otherwise controlled so that it stops after a short time, and will not be reactivated until the user gets up off of the seat, and the user again, sits on the seat or, a new user sits on the seat.

In the preferred embodiments of the present invention, the device is actuated mechanically in response to the user sitting down. Another example or variation of the disclosed embodiment is where the device has a base like the current version (section to hold the canister and U-shape to mount on the toilet bowl rim), but instead of springs and the top member 4, it has a rubber or resilient body on the base member, and the tube 20 carrying the deodorizing fluid passes through the resilient body. When the seat presses down on the resilient body, the tube will move down just as it does when the top member moves down, thus actuating the nozzle. The deflector can be mounted to the "spraying" end of the tube, by providing a "flared end" on the tube's upper half. It would look somewhat like the kind of straw that has a built-in spoon like end.

In another variation of the invention, the tube 20 is molded within or formed as part of (e.g., unitarily molded within) the top member 4.

In another variation of the invention, the canister may be of a type that continuously sprays, but a metering device is connected to the nozzle so as to limit the spray to only a metered amount. Other ways to limit the spray may also be used.

In a further version of the invention, top member 4 (or the resilient member) is fixed to the underside of the seat so there is no U-shape on the base or no need for a U-shape to the base member. For example, the top member or resilient member (without, a top member) has an adhesive, e.g., such as a peel and stick type of adhesive, or other way to mount to the underside of the seat.

Although the invention has been described using specific terms, devices, and/or methods, such description is for illustrative purposes of the preferred embodiment(s) only. Changes may be made to the preferred embodiment(s) by those of ordinary skill in the art without departing from the scope of the present invention, which is set forth in the following claims. In addition, it should be understood that aspects of the preferred embodiment(s) generally may be interchanged in whole or in part.

What is claimed is:

1. A device for controlling odor from a toilet bowl of a toilet, the device comprising:

a) a housing;

b) a canister having means having an opening for providing a substantially fixed predetermined amount of an odor treating spray when the means having an opening is moved relative to and toward the canister a predetermined amount, the odor treating spray being stored within the canister in a pressurized state as a fluid;

c) a mount on the housing for removably holding the canister outside the bowl, in a friction fit and enabling the means having an opening to move relative to the canister;

d) means on the housing for mounting the device on a rim of the toilet bowl;

e) a resilient member on the housing for biasing a seat of the toilet in an upward direction when the seat is empty, and f) a link member for moving down to actuate the means having an opening in response to someone sitting on the seat to move the seat down against the bias of the resilient member, the link member causing relative downward movement of the means having an opening to the canister to actuate the means having an opening to emit the odor treating spray, wherein the link member has fixed thereto a conduit having a first end for communicating with the means having an opening of the canister and having a spray outlet at a second end for providing an odor treating spray into the bowl, and g) wherein the link member and conduit are initially disposed out of communication with the means having an opening, and wherein in response to the relative movement of the link member and conduit downward, the conduit communicates with and actuates the means having an opening to cause fluid for the odor treating spray to be emitted from the canister through the means having an opening and up into the first end of the conduit and to be sprayed from the second end of the conduit.

2. The device of claim 1, wherein the means having an opening is disposed with the opening facing upward towards the seat.

3. The device of claim 2, wherein the canister is disposed with the means having an opening upward and the canister is at an end of the housing remote from the second end of the conduit.

4. The device of claim 1, wherein the canister has a rim below the means having an opening, and a neck below the rim, the neck having a smaller diameter than a diameter of the rim, and the neck and rim are fixed with respect to the canister, and wherein the mount comprises a flange member for holding the canister at the neck below and substantially against the rim.

5. The device of claim 1, wherein the canister is disposed with the means having an opening facing upward and the canister is at an end of the housing remote from the second end of the conduit.

6. The device of claim 1, wherein the conduit has an L-shape, and a first portion of the conduit having the first end of the conduit extends for a shorter distance than a second portion of the conduit leading to the second end of the conduit, the first and second portions of the conduit being disposed normal to each other.

7. A device for controlling odor from a toilet bowl of a toilet, the device comprising:

a) a housing having a housing member for mounting on a rim of a toilet bowl below a seat of the toilet;

b) a canister having an odor treating fluid, the canister being disposed on the housing outside of the bowl, and having a means having an opening for providing a substantially fixed predetermined amount of the odor treating fluid;

c) a passage having a first end in communication with the means having an opening for receiving the odor treating fluid and a second end for atomizing and dispersing the fluid into the toilet bowl; and d) a link member disposed at an upper end of the housing for contacting an underside of the seat of the toilet and moving downward relative to the canister in response to a user sitting on the seat to actuate the means having an opening to emit odor treating fluid up and into the first end of the passage and out the second end of the passage and into the toilet bowl, wherein at least a portion of the canister extends below the housing member and wherein the passage moves downward with the link member to move into fluid communication with and actuate the means having an opening of the canister, and wherein the link member and passage are initially disposed out of communication with the means having an opening, and wherein in response to the relative movement of the link member and passage downward the passage communicates with and actuates the means having an opening to cause the odor treating fluid to be emitted from the canister through the means having an opening and up into the first end of the passage and to be sprayed from the second end of the passage.

8. The device of claim 7, wherein the housing comprises a base member having an inverted U-shaped section for mounting on a rim of a toilet bowl.

9. The device of claim 7, wherein the housing comprises a section for holding the canister.

10. The device of claim 7, further comprising a biasing device for biasing the link member and seat upward.

11. The device of claim 10, wherein the link member forms a top member of the housing mounted on the biasing device to transfer downward motion of the seat against the biasing device to the means having an opening to actuate the means having an opening.

12. The device of claim 7, wherein the passage is separate from the housing.

13. The device of claim 7, wherein the second end has an opening sized for atomizing the fluid from the container.

14. The device of claim 7, wherein the container disperses only a limited amount of fluid in response to a single motion of the seat when a user sits on the seat.

15. The device of claim 7, wherein the passage has an L-shape, and a first portion of the passage having the first end of the passage extends for a shorter distance than a second portion of the passage leading to the second end of the passage, the first and second portions of the passage being disposed normal to each other.

16. A device for controlling odor from a toilet bowl, the device comprising:

a) a housing;

b) a canister having a means having an opening for providing a substantially fixed predetermined amount of an odor treating spray when the means having an opening is moved relative to and toward the canister a predetermined amount, the odor treating spray being stored within the canister in a pressurized state as a fluid;

c) a mount on the housing for removably holding the canister outside the bowl in a friction fit and enabling the means having an opening to move up and down relative to the canister;

d) means on the housing for mounting the device on a rim of the toilet bowl;

e) a resilient member on the housing for biasing a seat of the toilet in an upward direction when the seat is empty, and f) a link member for moving downward to actuate the means having an opening in response to someone sitting on the seat to move the seat down against the bias of the resilient member, the link member causing relative downward movement of the means having an opening to the canister to actuate the means having an opening to emit the odor treating spray, wherein the link member has fixed thereto a conduit for communicating at a first end with the means having an opening of the canister and having a spray outlet at a second end for providing an odor treating spray into the bowl, the spray outlet having an opening sized for atomizing the fluid from the container, and wherein in response to movement of the link member to actuate the means having an opening, the first end of the conduit moves downward and mates with the means having an opening and actuates the nozzle, and wherein the link member and conduit are initially disposed out of communication with the means having an opening, and wherein in response to the relative movement of the link member and conduit downward, the conduit communicates with and actuates the means having an opening to cause fluid for the odor treating spray to be emitted from the canister through the means having an opening and up into the first end of the conduit and to be sprayed from the second end of the conduit.

17. The device of claim 16, wherein the canister is disposed with the means having an opening upward and the canister is at an end of the housing remote from the second end of the passage.

18. The device of claim 16, wherein the canister has a rim below the means having an opening, and a neck below the rim, the neck having a smaller diameter than a diameter of the rim, and the neck and rim are fixed with respect to the canister, and wherein the mount comprises a flange member for holding the canister at the neck below and substantially against the rim.

19. The device of claim 16, wherein the conduit has an L-shape, a first portion of the conduit having the first end of the conduit extends for a shorter distance than a second portion of the conduit leading to the second end of the conduit, the first and second portions of the conduit being disposed normal to each other.

* * * * *